United States Patent [19]

Meier

[11] Patent Number: 4,548,144

[45] Date of Patent: Oct. 22, 1985

[54] SEWING MACHINE WITH CAM TYPE STITCH PATTERN CONTROL

[75] Inventor: Willi Meier, Karlsruhe-Durlach, Fed. Rep. of Germany

[73] Assignee: Dorina Nähmaschinene GmbH, Fed. Rep. of Germany

[21] Appl. No.: 634,123

[22] Filed: Jul. 25, 1984

[30] Foreign Application Priority Data

Aug. 27, 1983 [DE] Fed. Rep. of Germany ..... 3330928

[51] Int. Cl.[4] ..... D05B 3/02; D05B 3/04

[52] U.S. Cl. ..... 112/465; 112/314

[58] Field of Search ..... 112/158 F, 158 A, 158 D, 112/314, 315

[56] References Cited

U.S. PATENT DOCUMENTS

| | | | |
|---|---|---|---|
| 3,043,252 | 7/1962 | Engel | 112/158 A |
| 3,541,981 | 11/1970 | Watson | 112/158 A |
| 3,786,769 | 1/1974 | Coulombe | 112/158 A |
| 3,795,210 | 3/1974 | Adams et al. | 112/158 D |
| 3,807,329 | 4/1974 | Daman | 112/158 D |
| 4,084,523 | 4/1978 | Kasuga | 112/158 A |
| 4,095,540 | 6/1978 | Kaltenbach et al. | 112/315 |
| 4,106,419 | 8/1978 | Fresand | 112/158 A |
| 4,244,311 | 1/1981 | Sano | 112/158 A |
| 4,313,389 | 2/1982 | Hanyu et al. | 112/158 A |
| 4,497,267 | 2/1985 | Szustak et al. | 112/158 A |

*Primary Examiner*—Werner H. Schroeder
*Assistant Examiner*—Andrew M. Falik
*Attorney, Agent, or Firm*—McGlew and Tuttle

[57] ABSTRACT

A sewing machine is equipped with an automatic control assembly for the needle bight and/or the feed dog. The control assembly comprises a control cam block having a plurality of juxtaposed cam track portions to be operatively connected, through a contact mechanism, to the sewing machine needle or to a device for setting the feed dog. The contact mechanism comprises a contact finger which can be set by a handwheel, and a cam track connected to the handwheel, against one of the various cam track portions. The handwheel is mounted on a shaft carrying the control cam block, while the cam track connected to the handwheel forms a ring surrounding the control cam block. The contact finger directly engages the cam track, so that a control assembly of small overall length and having a small number of parts is obtained. To make straight seams, the contact finger can be displaced through the cam track into a position laterally of the control cam block, in which a contact member connected to the finger engages against stepped abutment surfaces of one of a set of switch cams which are also part of the handwheel.

9 Claims, 8 Drawing Figures

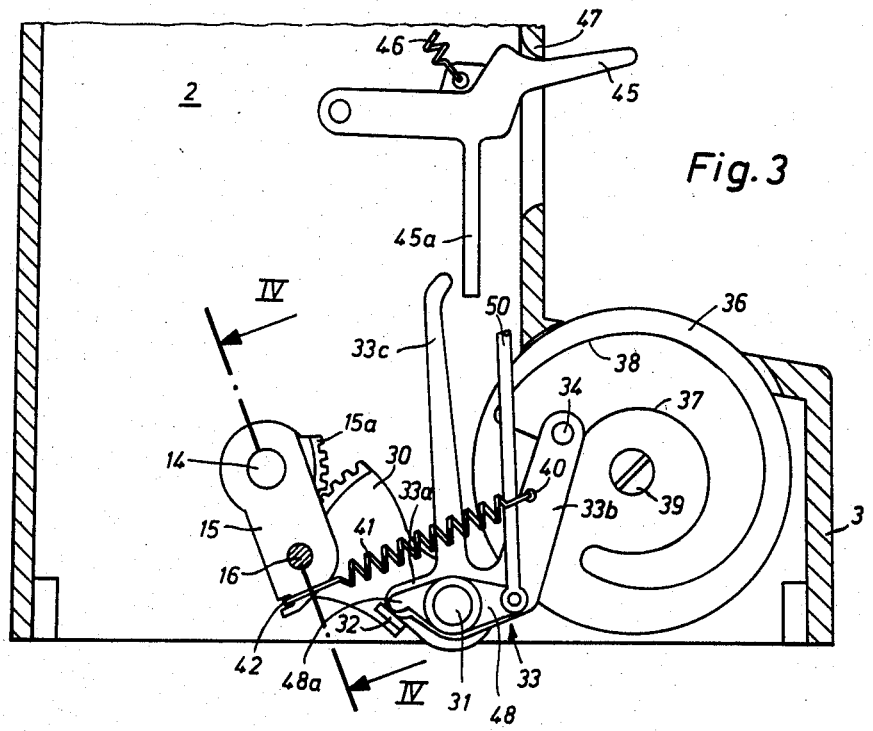
Fig. 3
Fig. 4
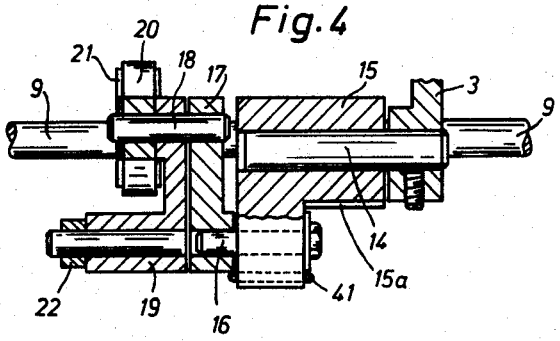
Fig. 5
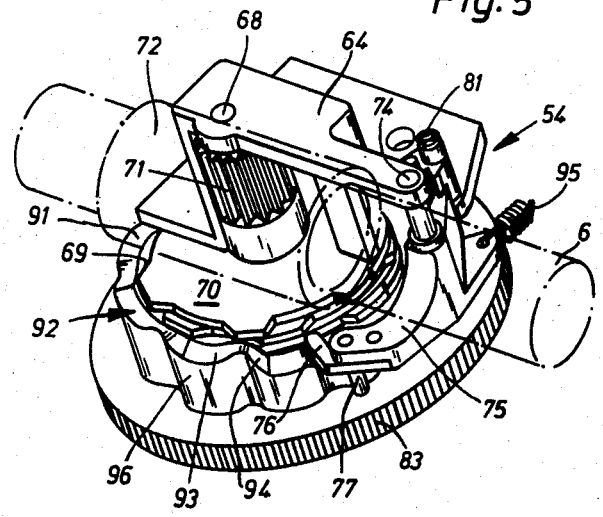

SEWING MACHINE WITH CAM TYPE STITCH PATTERN CONTROL

FIELD AND BACKGROUND OF THE INVENTION

The present invention relates in general to sewing machines and in particular to a new and useful cam type stitch pattern control for controlling the operation of either a needle bar swing arm or a setting device for a feed dog, or both.

Such a sewing machine is disclosed in U.S. Pat. No. 3,043,254. This prior art machine comprises a stack of control cam tracks which are engaged on a drive shaft and coupled thereto. Coaxially with the drive shaft, a hand-operated setting means is received in a fixed seat in the housing. This arrangement is very complicated and thus sensitive to disturbances and expensive to manufacture.

SUMMARY OF THE INVENTION

The present invention is directed to a compact assembly in which the control cam tracks and the setting means are united with each other.

The result of the inventive solution is a compact assembly having a small number of parts, which can be secured to the sewing machine housing in a most simple manner. The contact finger directly engages against the cam track aligned with the cam plates, so that these plates can be thinner since any play due to transmission levers is absent and the contact finger always exactly follows the set cam track portion.

Accordingly an object of the present invention is to provide a sewing machine which includes a needle bar swing arm having a needle bar vertically guided therein, a feed dog with setting means for controlling the feed dog amount and feed direction of the feed dog, and a control mechanism having a control mechanism shaft, wherein a control cam block is mounted to the shaft and has a plurality of cam track portions which extend alongside each other and can be selectively engaged by a contact mechanism for selectively moving either the needle bar swing arm or the setting means of the feed dog. A handwheel is mounted to the control mechanism shaft and engages the contact mechanism. The contact mechanism comprises a contact finger which can be applied by the handwheel against one of the various cam track portions and which cooperates through a contact member with switch cams that are also formed on the handwheel. During switching from one cam track portion to another, the contact finger is initially lifted from the cam track block against the action of a biasing spring and then is displaced through a helical cam track extending in an axial direction of the shaft. The helical cam track is also formed on the hand wheel and further rotation of the handwheel causes the contact to again engage the control cam block. The handwheel is mounted on the control mechanism shaft so that the contact finger can directly engage the helical cam track.

A further object of the invention is to provide such a sewing machine wherein the helical cam track is formed as a ring which surrounds the control cam block and which carries the switch cams that cooperate with a contact member connected directly to the contact finger.

A still further object of the invention is to provide such a sewing machine wherein the contact finger is displaceable through the helical cam track into a position laterally outside the control cam block and which the contact member that is connected to the fingr, engages against stepped abutment surfaces of one of the switch cams.

These features make it possible to omit transmission elements for lifting the contact finger from the cam track portions during the switching operation.

A still further object of the invention is to provide a sewing machine which includes control mechanism and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is shown in the accompanying drawings in which:

FIG. 3 is a sectional view taken along the line III—III of FIG. 2;

FIG. 4 is a sectional view taken along the line IV—IV of FIG. 3;

FIG. 5 is a perspective view of one of the control assemblies;

DESCRIPTION OF THE PREFERRED EMBODIMENT

Figure 1:
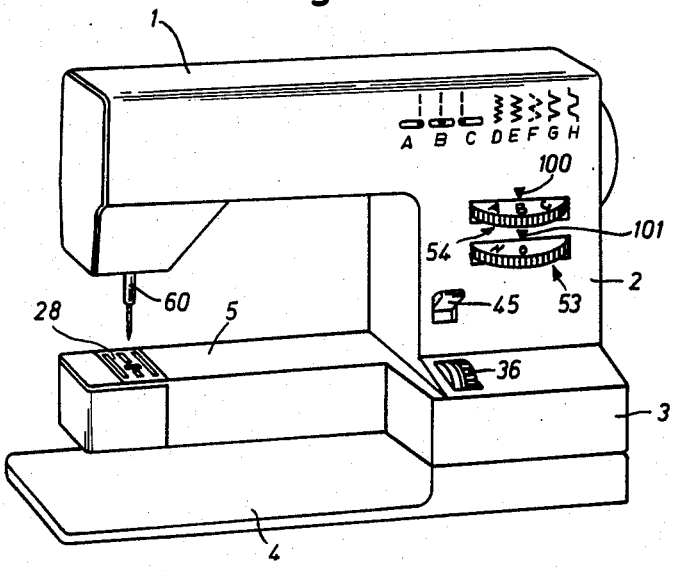
FIG. 1 is a perspective view of the inventive sewing machine.

Referring to FIG. 1, the sewing machine of this invention comprises an arm 1 connected through a post 2 to a base 3. Base 3 is supported on a base plate 4 which is enlarged toward the front, relative to post 2 and arm 1. A work supporting arm 5 extends from base 3 along the base plate and is offset rearwardly relative to the axis of symmetry thereof. Arm 5 accommodates the lower mechanism for forming the stitches, particularly a rotary hook of the sewing machine.

Figure 2:
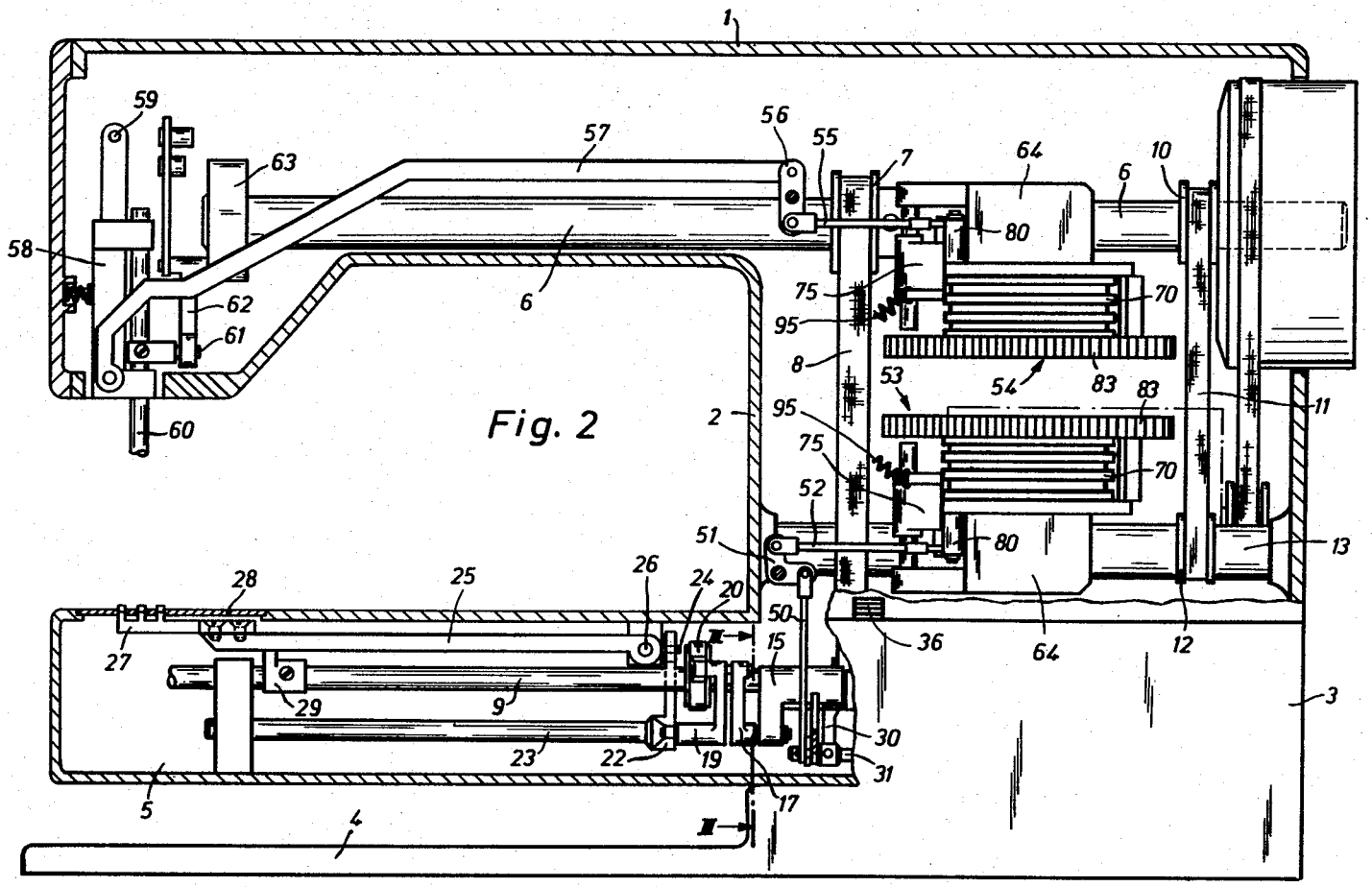
FIG. 2 is an enlarged front view of the machine, partly in section.

An arm shaft 6 (FIG. 2) mounted in arm 1 drives, through a wheel 7, a cog belt 8 and thus a wheel (not shown) carried on a lower shaft 9 by which the rotary hook is driven in a manner known per se.

Also driven by arm shaft 6, through a wheel 10 is a cog belt 11, a wheel 12, and in a ratio of one to one, a shaft 13 which is mounted in post 2.

In base 3 of the sewing machine, a pin 14 (FIGS. 3,4) is fixed on which a setting member 15 is mounted for free rotation. Rigidly connected to setting member 15 are a geared segment 15*a*, and a bolt 16 carrying a link 17. Link 17 is hinged through a pin 18 to another link 19. Pin 18 is acted upon by an eccentric rod 20 (shown coming in a direction out of the page in FIGS. 2 and 4) embracing an eccentric 21 which is mounted on shaft 9.

Link 19 (FIG. 2) is connected to an arm of a bell crank lever 22 which is secured to a shaft 23 mounted in work support arm 5. The other arm extending upwardly from lever 22 has a guide slot on its upper end, in which a pin 24 is guided. Pin 24 is secured to a carrier arm 25 which is mounted for displacement on a horizontal shaft 26 which extends in the feed direction. On its free end, carrier arm supports a feed dog 27 whose teeth projecting through the needle plate 28 engage the work. Carrier arm 25 rests on a lifting eccentric 29 which is secured to shaft 9.

Gear segment 15*a* (FIG. 3) meshes with another geared segment 30 which is mounted on a shaft 31 supported on base 3, and carries a laterally projecting stop 32. One arm 33*a* of a lever 33 cooperates with stop 32, another arm 33*b* carries a pin 34 which projects between two cam tracks 37.38 provided on the front surface of a setting disc 36. Setting disc 36 is mounted for rotation about a flanged screw 39 secured to base 3. Arm 33*b* of lever 33 has a hole 40 to which one end of a spring 41 is attached, while the other end of the spring engages a recess 42 of setting member 15. Hole 40 and recess 42 are provided on drive connection parts which move in the same direction. The transmission ratio of the drive connection through lever 33 and geared segments 30 and 15*a* is selected so that during the common movement, recess 42 has a larger moving range than hole 40. Since spring 41 tends to contract, the system turns so as to hold pin 34 against cam track 37.

Lever 33 has a third arm 33*c* extending upwardly and capable of cooperating with an arm 45*a* of an actuating lever 45 for reversing the advance motion into back stitch motion. Actuating lever 45 is mounted in post 2 of the sewing machine and is urged against an upper stop 47 by a spring 46 attached thereto.

Further mounted on shaft 31 is a bell crank lever 48. Lever 48 has a contact nose 48*a* projecting against stop 32. The other end of lever 48 is connected to a rod 50 cooperating, through a reversal lever 51 (FIG. 2) mounted on post 2, and a connecting rod 52, with a control assembly 53 which is accommodated within post 2.

Above control assembly 53, another control assembly 54 is provided in post 2, which is connected through a connecting rod 55, a double lever 56, and a connecting bar 57, to needle bar swing arm 58. Swing arm 58 is hinged to a bolt 59 in arm 1 and carries a vertically movable needle bar 60. Needle bar 60 carries a pin 61 firmly connected to and engaged with a link 62 which is hinged to a crank 63 secured to arm shaft 6 for moving a needle on bar 60 up and down for sewing.

The two control assemblies 53,54 are substantially of identical design. Therefore, only one of them is described in the following. Control assembly 54 comprises a support 64 (FIGS. 5,6) which is fixed by screws 65 to a rib 66 of post 2. Screws 65 extend through oblong holes 67 in rib 66, to be able to adjust the position of assembly 54 in the longitudinal direction of arm shaft 6. Secured to support 64 is a shaft 68 on which a control cam block 70 is mounted for rotation, carrying various cam track portions 69 and a worm gear 71 fixed thereto. Worm gear 71 meshes with a drive worm 72 which is secured to arm shaft 6. Cam track block 70 is guided between the wall of support 64 and a guard ring 73 which is secured to shaft 68.

Further provided is another shaft 74 extending parallel to shaft 68 (FIGS. 5-7) and also secured to support 64. A contact lever 75 is mounted on shaft 74 for pivoting and axial displacement. Secured to contact lever 75 is a contact finger 76 which cooperates with cam track portions 69 and carries a contact member 77 which extends perpendicularly to the plane of movement of contact finger 76. The other end of contact lever 75, opposite to contact finger 76, is designed with two teeth 78 which are engaged with a tooth 79 of an oscillating member 80. Member 80 is mounted on a third shaft 81 secured to support 64, and carries a hinge pin 82 which is connected to needle bar swing arm 58 through connecting rod 55 (FIG. 2), double lever 56, and connecting bar 57.

Figure 6:
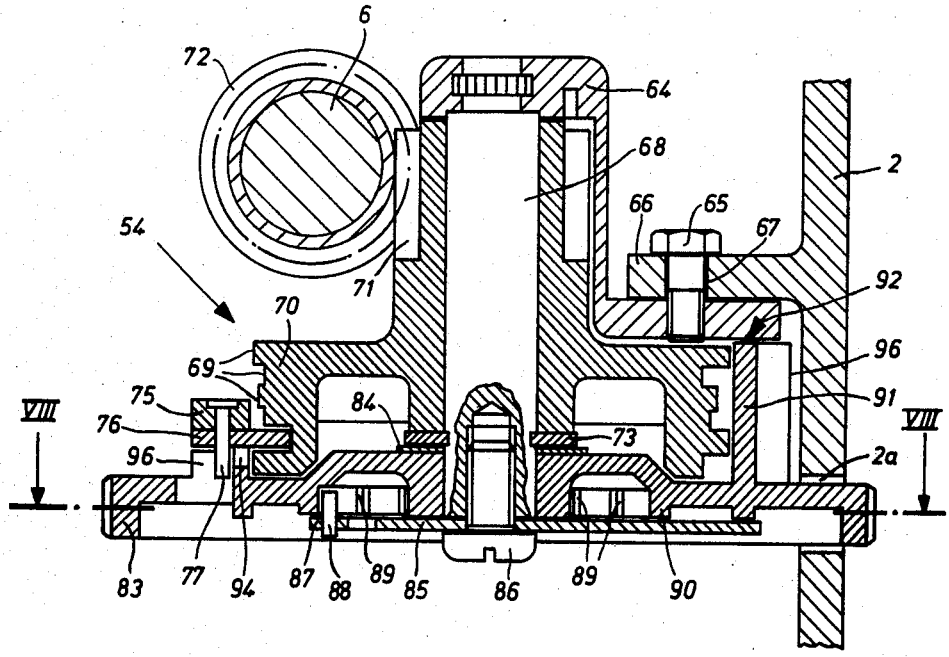
FIG. 6 is an enlarged sectional view of a control assembly.
Figure 7:
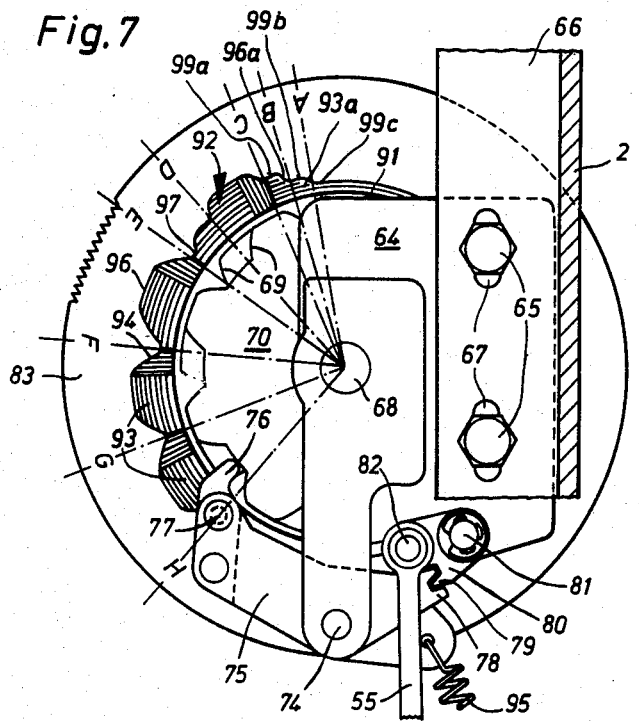
FIG. 7 is a top plan view of a control assembly.
Figure 8:
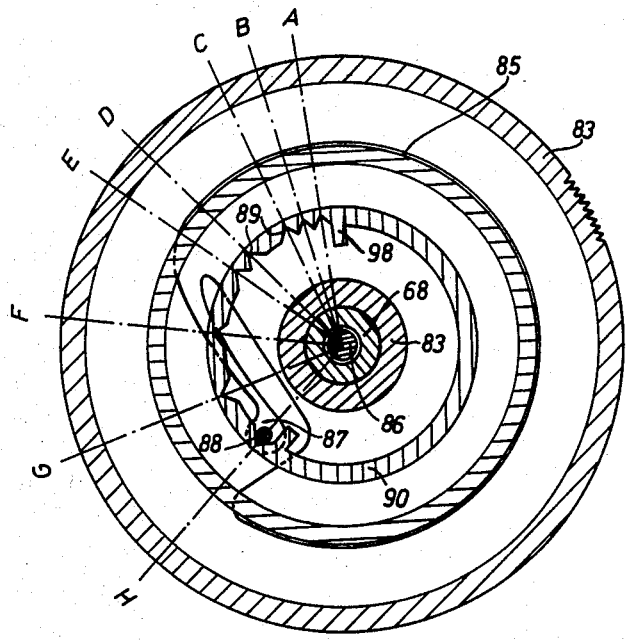
FIG. 8 is a sectional view taken along the line VIII—VIII of FIG. 6.

Beneath control track block 70 (FIGS. 5-7) means for manual setting in the form of a handwheel 83, is mounted which is pressed against a washer 85 by a brake swing disc 84 held in place by a screw 86 screwed into shaft 68. Washer 85 is formed with an arm 87 which is resiliently movable in the radial direction and whose free end carries a pin 88 cooperating with detents 89 which are provided in an annular wall 90 of handwheel 83 (FIG. 8). To be accessible for setting, handwheel 83 protrudes from post 2 of the sewing machine through a slot 2*a* (FIG. 6). When set, handwheel 83 is held in position by the springyness of arm 87, holding pin 88 in one of the detents 89.

Handwheel 83 carries another annular wall or ring 91 surrounding cam track block 70. Wall 91 is designed as a substantially helical cam track 92 extending in the axial direction and comprising steps 93 and transitions 94 therebetween. Under the action of a spring 95 (FIG. 5) hooked between contact lever 75 and post 2, contact finger 76 engages against steps 93 or transition inclines 94.

In the radial direction, wall 91 is formed with switch cams 96 which extend each over the length of a step 93 and a transition incline 94. The purpose of switch cams 96 is to temporarily lift contact finger 76 from cam track block 70, which is effected through contact member 77 as handwheel 83 is turned. Formed between the individual switch cams 96 are notches 97 which are deep enough to allow free motion of contact member 77 in an arrested position of handwheel 83, during a rotation of the cam track block 70.

The setting range of handwheel 83 is limited by end stops 98 (FIG. 8) which are connected to wall 90 and against which pin 88 abuts. The step 93*a* at one range end of cam track 92 (FIG. 7) is so dimensioned that contact finger 76 is retained in a position laterally outside cam track block 70. The switch cam 96*a* associated with this step 93*a* has abutment surfaces 99*a*, 99*b*, 99*c* against which contact member 77 engages and by which the position of the contact finger is determined.

Handwheel 83 is marked with letters (FIG. 1) A to H corresponding to the various arrest positions and can be set against a corresponding mark 100 provided on post 2. The design of control assembly 53 for controlling the feed motion of feed dog 27 is substantially identical with that of control assembly 54. The sole differences are the shape of cam track portions 69, and a single abutment surface 99*c* of switch cam 96*a* for pivoting contact lever 75 into a position in which the maximum feed is adjusted. Worm 71 of control assembly 53 is engaged with shaft 13.

Handwheel 83 of control assembly 53 is marked with letters M, N, and O (FIG. 1) which can be set against a corresponding mark 101 on post 2. In the position O, contact lever 75 is in a position laterally of cam back block 70, i.e. the function of the control assembly is off.

The sewing machine operates as follows:

With arm shaft 6 (FIG. 2) in rotary motion, both shaft 9 driven through belt 8 and shaft 13 driven through belt 11 rotate at the same speed as shaft 6. Rotated along with shaft 9 is eccentric 21 (see also FIG. 4) by which bell crank lever 22 is swung out through eccentric rod 20 and link 19. Lever 22 thus imparts shifting movements to carrier arm 25 and feed dog 27.

The lifting movements of feed dog 27, caused by lifting eccentric 29 secured to shaft 9, are synchronized with the shifting movements, and feed dog 27 is thereby lifted above needle plate 28 to engage by its teeth the work.

With control assembly 53 set to the latter O, the length of the feed step of feed dog 27 is adjusted by setting disc 36. Under the action of spring 41, pin 34 engages against inner cam track 37 and displaces setting member 15 through lever 33, stop 32, and the two geared segments 30 and 15*a*. This also displaces bolt 16 which is the axis of rotation of link 17 (see FIGS. 2 and 4). Therefore, as pin 18 is swung out by eccentric rod 20, link 17 performs a pure rotary motion about bolt 16, while link 19, in addition to this rotary motion, also performs a relative motion about its hinge point on bell crank lever 22. This relative motion is transferred through lever 22 as a shifting motion to carrier arm 25. Carrier arm 25 slides on its shaft 26 back and forth thereby imparting to feed dog 27 shifting movements the amount of which depends on the setting of disc 36.

For backstitching, feed dog 27 is reversed by pushing down actuating lever 45 (FIG. 3), against the action of spring 46. Arm 33*c* of lever 33 is thereby pivoted counterclockwise (FIG. 3) so that arm 33*a* imparts a pivotal motion through stop 32 to geared segment 30 until pin 34 engages against cam track 38. At the same time, setting member 75 is pivoted by geared segment 30 into its position provided for back stitching.

Upon releasing actuating lever 45, setting member 15 and pin 34 return into their previous positions under the action of spring 41, and actuating lever 45 butts against its stop 47. The swing range of needle bar swing arm 58 is controlled by control assembly 54 (FIGS. 5–8). The respective control program is set through handwheel 83. While turning handwheel 83, contact member 77 and thus contact finger 76 are swung radially outwardly by one of the switching cams 96, so that contact finger 76 slidably lifts from the cam track block 70, on the respective step 93 extending parallel to the just selected cam track portion 69. While further turning handwheel 83, contact finger 76, now sliding along the respective transition incline 94, becomes aligned with the next cam track portion 69, whereupon switch cam 96 releases contact member 77 and contact finger 76 engages against the cam track portion 69 under the action of spring 95.

With the rotation of control cam block 70, the selected cam track portion 69, through contact lever 75, causes pivoting of oscillating member 80. Member 80 in turn causes pivoting of needle bar swing arm 58, through hinge pin 82, connecting rod 55, double lever 56, and connecting bar 57, in accordance with the shape of the selected cam track portion 69.

The sewing machine thus sews a pattern corresponding to the setting of handwheel 83 and indicated by the respective letter symbol.

An automatic control of feed dog 27 (FIG. 2) is obtained by turning handwheel 83 of control assembly 53 into a position other than indicated by the letter O. During rotation of control cam block 70, the cam track portion 69 thus selected causes pivoting of oscillating member 80, through contact lever 75. Oscillating member 80 in turn, through connecting rod 32, reversal lever 51, rod 50, bell crank lever 48 (FIG. 3), and geared segment 30, causes pivoting of stitch setting 15 in accordance with the shape of the selected cam track portion 69. To completely utilize the movements of feed dog 27 upon engaging control assembly 53, the disc 36, of course, is to be set to maximum feed length of the feed dog.

While a specific embodiment of the invention has been shown and described in detail to illustrate the application of the principles of the invention, it will be understood that the invention may be embodied otherwise without departing from such principles.

What is claimed is:

1. In a sewing machine having a frame, a swing arm mounted to the frame, a needle bar guided for reciprocal motion in the swing arm and movable by the swing arm to form a switch pattern, a feed dog movably mounted to the frame for moving a workpiece to form a stitch pattern, and setting means engaged with the feed dog for controlling a feed amount and direction of the feed dog, a stitch pattern control comprising:

a shaft connected to said frame;

a cam block mounted on said shaft at an axially fixed location and for rotation only and having a plurality of cam track portions extending alongside each other;

a contact mechanism engaged with one one of said swing arm and setting means and having a contact finger selectively engageable with one of said cam track portions, a contact member engageable with each of a plurality of switch cams for switching position of said contact finger, and biasing means for biasing said contact finger against said cam track portions; and hand-operated setting means mounted to said shaft for rotation and comprising a ring surrounding said cam block and defining an axially extending cam track extending axially with respect to said shaft and engageable with said contact mechanism for moving said contact finger from one cam track portion to another, a plurality of switch cams against which said contact member is engaged for cooperating with said axial cam track to lift said contact finger from one cam track portion against biasing of said biasing means, to thereafter move said contact finger to another cam track portion and to finally bring said contact finger back into engagement with another cam track portion, when said hand-operated setting means is rotated, said contact finger being in direct engagement with said axial cam track.

2. A stitch pattern control according to claim 1, wherein said switch cams extend radially of said ring and with respect to said shaft, said contact member connected to said contact finger.

3. A stitch pattern control according to claim 2, wherein said ring includes stepped abutment surfaces associated with one of said switch cams against which said contact member is engageable for moving said contact finger into a position laterally away from said cam track block.

4. A stitch pattern control according to claim 3, wherein said hand-operated setting means comprises a handwheel carrying said axial cam track, said plurality of switch cams and said stepped abutment surfaces.

5. A stitch pattern control according to claim 4, wherein said handwheel includes a second ring disposed radially of said first mentioned ring and including a plurality of internal detents, a washer connected to said shaft at a fixed position with respect to said handwheel and including a pin engageable with one of said detents for holding said handwheel in a selected position.

6. In a sewing machine having a frame, a swing arm mounted to the frame, a needle bar guided for reciprocal motion in the swing arm and movable by the swing arm to form a stitch pattern, a feed dog movably mounted to the frame for moving a workpiece to form a stitch pattern, and setting means engaged with the feed dog for controlling a feed amount and directions of the feed dog, a stitch pattern control comprising:

a shaft connected to said frame;

a cam block mounted on said shaft for rotation and having a plurality of cam track portions extending alongside each other;

a contact mechanism engaged with one of said swing arm and setting means and having a contact finger selectively engageable with one of said cam track portions, a contact member engageable with one of a plurality of switch cam for switching position of said contact finger, said contact member being connected directly to said contact finger, and biasing means for biasing said contact finger against said cam track portions; and hand-operated setting means mounted to said shaft for rotation and comprising a ring surrounding said cam block and defining an axially extending cam track extending axially with respect to said shaft and engageable with said contact mechanism for moving said contact finger from one cam track portion to another, a plurality of switch cams against which said contact member is engaged for cooperating with said axial cam track to lift said contact finger from one cam track portion against biasing of said biasing means, to thereafter move said contact finger to another cam track portion and to finally bring said contact finger back into engagement with another cam track portion, when said hand-operated setting means is rotated, said contact finger being in direct engagement with said axial cam track, said switch cams extending radially of said ring and with respect to said shaft.

7. A sewing machine comprising: a needle bar swing arm; a feed dog; a needle bar vertically guided in the needle bar swing arm; setting means for controlling the feed amount and feed direction of the feed dog; a control mechanism shaft; a control cam block mounted for rotation at an axially fixed location on the shaft and carrying a plurality of cam track portions which extend one alongside the other; a contact mechanism for connecting the cam track portions to one of the needle bar swing arm and the setting means for setting the feed dog; hand-operated setting means rotatively mounted on the shaft at an axially fixed location for setting the contact mechanism to one of the cam track portions; the contact mechanism comprising a contact finger which can be engaged by the hand-operated setting means against one of the various cam track portions and which cooperates through a contact member with switch cams which are firmly connected to the hand-operated setting means and by which, during a switching from one cam track portion to another the contact finger is initially lifted from the control cam block, against the action of a spring, then displaced through a helical cam track extending in an axial direction of the shaft and firmly connected to the hand-operated setting means, and finally brought back into effective contact with the control cam block; the hand-operated setting means being mounted on the control mechanism on which the control cam block is carried; the helical cam track which is connected to the hand-operated setting means being formed as a ring surrounding the control cam block; and the contact finger directly engaging the helical cam track.

8. A sewing machine according to claim 7, wherein the cam track ring carries the switch cams which protrude radially of the shaft and cooperate with a contact member which is connected to the contact finger.

9. A sewing machine according to claim 8, wherein the contact finger is displaceable through the helical cam track into a position laterally outside the control cam block, in which the contact member connected to the finger engaged against stepped abutment surfaces of one of the switch cams.

* * * * *